US006363676B1

(12) United States Patent
Martion, III

(10) Patent No.: US 6,363,676 B1
(45) Date of Patent: Apr. 2, 2002

(54) SIDING HAVING DOUBLE THICK NAIL HEM

(75) Inventor: William Frederick Martion, III, Weatherford, TX (US)

(73) Assignee: Jancor, Inc., Bardstown, KY (US)

( * ) Notice: Subject to any disclaimer, the term of this patent is extended or adjusted under 35 U.S.C. 154(b) by 0 days.

(21) Appl. No.: 09/497,398

(22) Filed: Feb. 3, 2000

(51) Int. Cl.[7] ..... E04D 1/00
(52) U.S. Cl. ..... 52/519; 52/521; 52/545
(58) Field of Search ..... 52/578, 588.1, 52/519, 520, 521, 543, 545, 547, 548, 364, 478

(56) References Cited

U.S. PATENT DOCUMENTS

| | | | | | |
|---|---|---|---|---|---|
| 3,325,952 | A | | 6/1967 | Trachtenberg | 52/276 |
| 3,343,325 | A | | 9/1967 | Curran | 52/478 |
| 4,226,069 | A | | 10/1980 | Hinds | 52/521 |
| 4,947,609 | A | * | 8/1990 | Champagne | 52/545 |
| 5,224,318 | A | * | 7/1993 | Kemerer | 52/521 |
| 5,685,117 | A | | 11/1997 | Nicholson | 52/520 |
| 5,878,543 | A | | 3/1999 | Mowery | 52/519 |

* cited by examiner

*Primary Examiner*—Beth A. Stephan
*Assistant Examiner*—Naoko Slack
(74) *Attorney, Agent, or Firm*—Stevens, Davis, Miller & Mosher, L.L.P.

(57) ABSTRACT

A siding panel for installation on walls, soffits or other exposed surfaces of a structure, having a nailing hem folded back upon itself to form a double thick lateral edge of the siding panel. A plurality of elongated apertures are defined in the nailing hem, which apertures are surrounded by longitudinally extended protrusions or bumps. The protrusions or bumps are spaced apart less than the width of the head of a carpenter's hammer, such that a nail or other fastener cannot be fully set flush against the surface of the nailing hem. The double thick nailing hem provides increased strength and the provision of the bumps permits relatively longitudinal movement of the siding relative to the head of the fastener. A novel interlocking reverse S configuration is provided adjacent the nailing hem so as to interlock with a corresponding portion on the opposing longitudinal edge of the siding.

9 Claims, 2 Drawing Sheets

SIDING HAVING DOUBLE THICK NAIL HEM

BACKGROUND OF THE INVENTION

1. Field of the Invention

This invention relates to siding, particularly siding for insulation on the walls, soffits or other exposed surfaces of a structure, having a nailing hem folded back upon itself, away from the finished side of the siding. A plurality of apertures are formed completely through the folded back nailing hem and longitudinal protrusions or "bumps" run the length of the siding to prevent the fasteners normally used to fasten the siding to the wall, soffits or other exposed surfaces of the structure from being set flush within the nailing hem.

2. Description of the Related Art

The provision of siding to cover the exterior surfaces of structures, such as buildings, has been in use for many years and in its current forms are being fabricated from ductile metals, such as aluminum, and polymeric material. An example of such a siding is shown in U.S. Pat. No. 5,878, 543.

However, there continues to be a need for siding that is easier to install, is more durable than products on the market, enhancing the ability to withstand forces such as wind, without becoming detached from the building upon which they are installed, as well as containing aesthetic features pleasing to the eye.

SUMMARY OF THE INVENTION

It is, therefore, a purpose of the invention to provide a siding panel for installation on walls, soffits and other exposed surfaces of a structure having a profiled contour. At one edge of the siding is provided a nailing hem, which is formed of a material which is bent back upon itself to form a lateral edge of the siding panel and on the other edge of the siding panel is provided an interlocking flange such that it maybe received within an interlocking portion provided adjacent the nailing hem so as to retain both the top and bottom portions of the siding in firm communication so as to cause the siding to better withstand the elements, including wind, rain, etc. and thereby to protect the building on which it is installed.

The nailing hem of the siding of the present invention also has two protrusions or "bumps" longitudinally extending on either side of a series of apertures formed in the nailing hem. These "bumps" prevent the installer from driving the nail or other fastener flush with the siding and, therefore, provide a slight gap between the head of the fastener and the nail hem. This gap permits the siding to move longitudinally with relation to the fasteners and assists in resisting forces which would otherwise dislodge the siding.

DETAILED DESCRIPTION OF THE PREFERRED EMBODIMENTS

Figure 1:
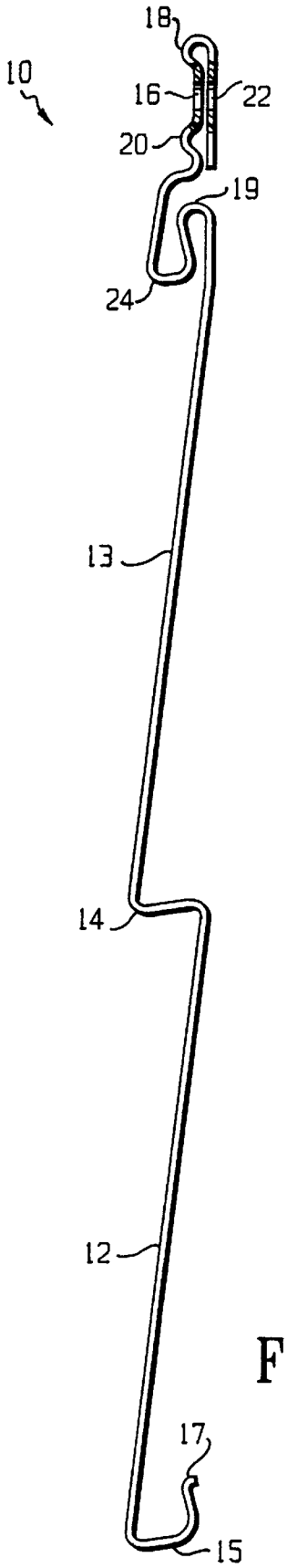
FIG. 1 is a side view of a siding panel according to the invention.
Figure 2:
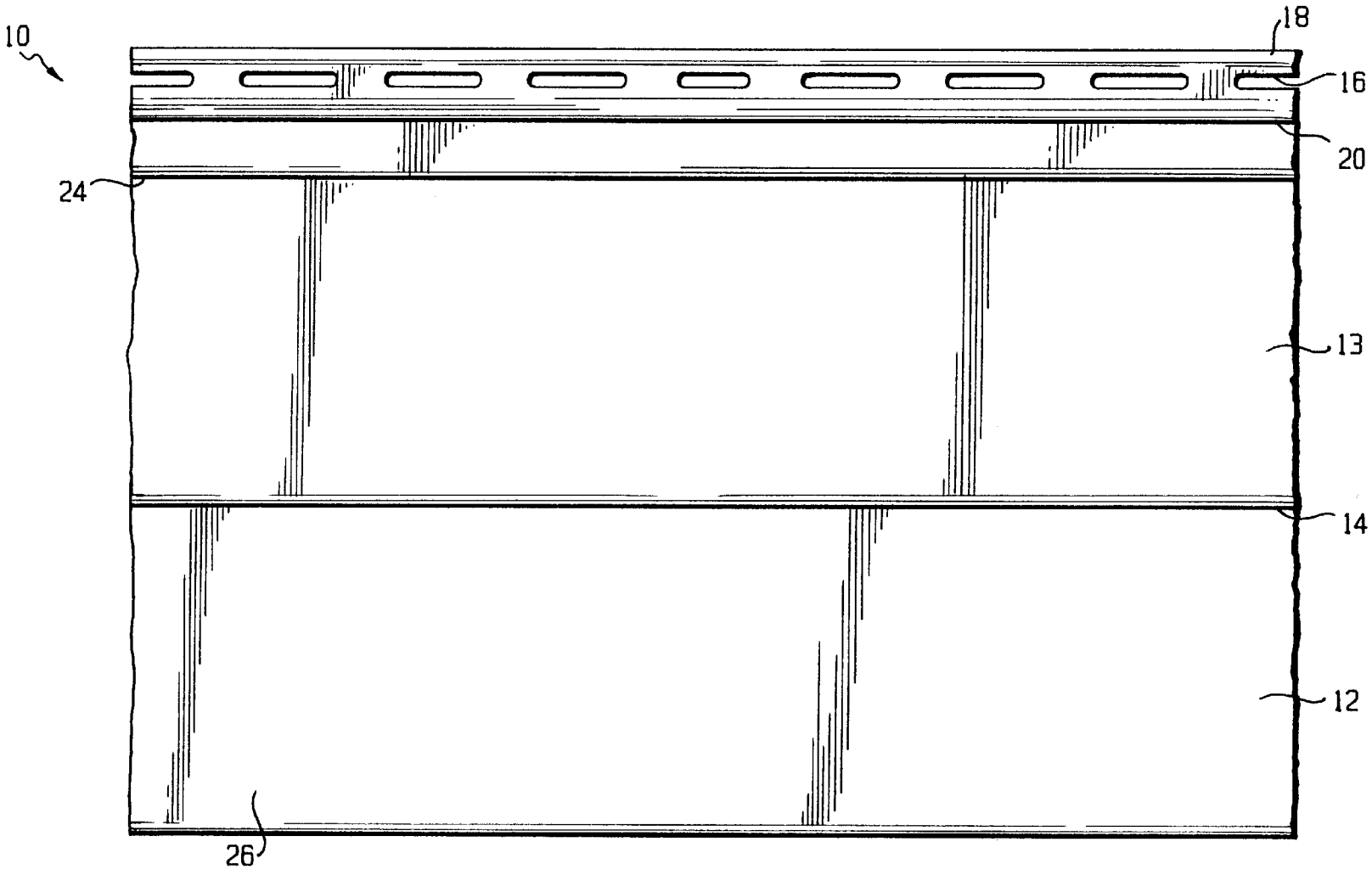
FIG. 2 is a front view of the siding of FIG. 1.

As shown in FIGS. 1 and 2 is a siding panel 10 which has a configuration mimicking two clapboards 12, 13. The transition 14, between the two clapboards, takes the shape of a nose, thereby forming a drip edge when the siding 10 is installed on a wall of a structure.

Figure 3:
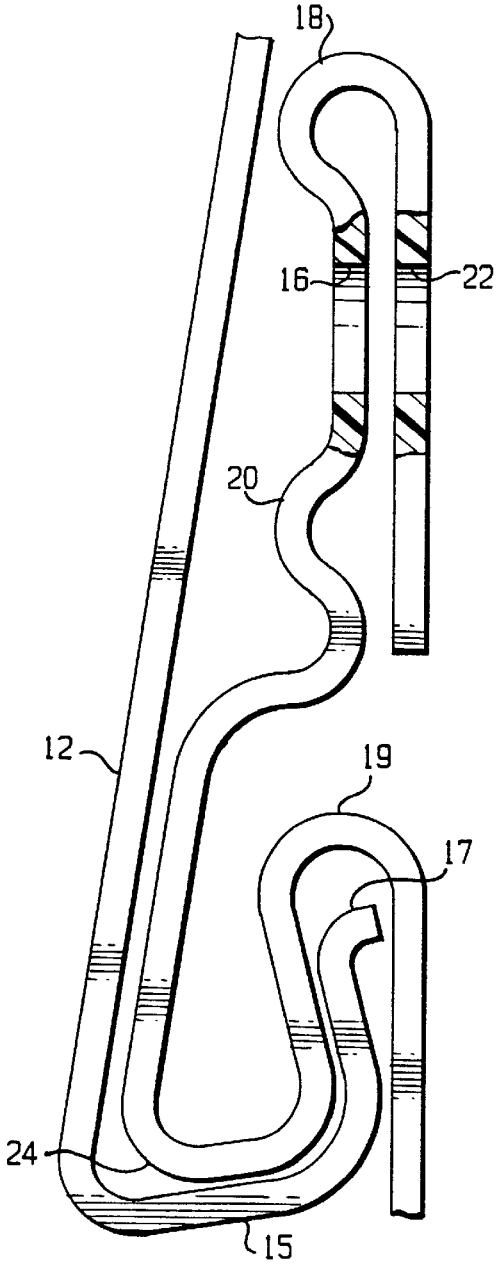
FIG. 3 is an enlarged, right-side view of the interlocked portions of adjacent siding panels.

At one end of the panel is formed an interlocking portion 15 designed to interlock with a similarly shaped panel by inserting the protrusion 17 into an opening formed by a reverse S portion 19, when viewed from the right side, adjacent to the nailing hem as best shown in the enlarged view of FIG. 3. The nailing hem defines a plurality of apertures which extend completely through the nailing hem, including a bent back portion of the nailing hem so as to give a double thickness to the nailing hem.

In its most preferably configuration, the apertures are elongated slots, though they do not need to be of identical dimensions. Adjacent these elongated slots, which are arranged with their axis parallel to the longitudinal direction of the siding, are provided two protrusions or bumps 18, 20. These bumps 18, 20 are spaced and configured so as to prevent the face of a tool used to drive fasteners for driving the fasteners tight against the nail hem, e.g., the bumps 18, 20 are spaced less than the width of the head of a carpenter's hammer, such that when a fastener, such as a nail, is driven with a hammer through the slots 16, 22 and into the underlying building structure, the bumps prevent the hammer head from fully seating the head of the fastener tightly against the nailing hem. The slight space between the nail head and the siding permits relative longitudinal movement of the panel relative to the nail. This movement is an aid in resisting the forces of the elements, such as wind, rain, etc., from otherwise dislodging the panel as installed on the structure, together with similarly configured siding panels.

The panel of the invention maybe manufactured by extruding the profile of FIG. 1 from a polymeric material in the configuration as shown in FIG. 1.

Alternatively, the panel shown in FIG. 1 maybe formed from a flat sheet of feed stock (the feedstock itself having been extruded, calendered, cast, or otherwise configured as a planar sheet stock), which sheet stock is then reshaped into the profile of FIG. 1. The reshaping of a flat feedstock has some advantage insofar as it creates orientation of molecules making the transitions, especially at 14 and 24 stronger because of this orientation. The provision of a flat sheet stock also makes it possible to impart a desired texture to the surface 26 of the siding panel during the manufacture of the flat sheet stock. Such desired configurations can mimic wood grain, stucco, and other similar configurations.

The provision of the bent back nailing hem also provides a double thick portion of the siding panel in the vicinity of the fasteners which are used to attach the siding panel to the building structure. This double thick nailing hem thereby increases the strength of the panel in the vicinity of the fasteners of the panel to the structure. Moreover, by bending back, rather than bending forward the nailing hem, the provision of the bumps or protrusions 18, 20, together with the "hinged" nature of the nail hem and bent back portion can be utilized to prevent full setting of the head of the fastener tight against the surface of the siding panel.

Moreover, the configuration 17 assures a tight interlock of the lower portion of the panel with a corresponding reverse S shaped portion 19 of a similar panel. Because the siding panel of the present invention strengthens the nailing hem portion, the interlocking projection 17 assures a strong interfit of the panels as illustrated in the enlarged drawing of FIG. 3.

While I have described siding in the sense of exterior cover for walls of buildings, the invention may be applied to roofs, patio covers, or elsewhere.

While I have shown and described certain preferred embodiments of my invention and specifically set forth certain objects and advantages, other objects and advantages are secured by my invention, as will be apparent to those skilled in the art and various changes and modifications may be made within the contemplation of my invention and under the scope of the following claims.

I claim:

1. A siding panel adapted to be installed in an overlapping relationship and an interlocking manner with other adjacent siding panels comprising:

(a) a nailing hem adjacent a lateral edge of said siding panel;

(b) said nailing hem comprising a face portion and a rear portion to define a double thick nailing hem and a reverse S configuration, as viewed from the right side of said panel when installed, adjacent said nail hem designed to receive a lateral edge of an adjacent panel;

(c) said rear portion being formed by folding the face portion rearward onto itself;

(d) said nailing hem defining a plurality of apertures extending through said double thick nailing hem; and (e) two longitudinally extending protrusions, one on either side of said apertures so as to prevent the face of a tool, driving a fastener through the apertures, from driving the head of the fastener tight against the nail hem.

2. The siding panel of claim 1, wherein the apertures are elongated slots.

3. The siding panel of claim 1, wherein said lateral edge includes a protrusion designed to interlock into said reverse S configuration.

4. The siding panel of claim 1, wherein said panel is made of polymeric material.

5. The siding panel of claim 4, wherein said polymeric material on the face of said siding panel is provided with a surface texture.

6. A method of installing a siding panel, said method comprising:

(a) providing a siding panel having a nailing hem adjacent a lateral edge;

(b) providing elongated slots in said nailing hem;

(c) providing two longitudinally extending bumps; one on either side of said slots;

(d) driving a fastener through said slots, whereby the bumps prevent the fastener from flushly contacting the nailing hem; and (e) inserting a projection on a lateral edge of the siding panel into a reverse S configuration on a similar, previously installed, adjacent panel.

7. The method of claim 6, wherein the nail hem is double thickness and the fastener is driven through said double thickness.

8. The method of claim 7, wherein the double thickness is formed by bending the nail hem backwards on itself to form said double thickness.

9. The method of claim 6, wherein the step of inserting said projection on a lateral edge of the siding panel into said reverse S configuration includes pulling towards a nailing hem of a previously installed adjacent panel.

* * * * *